US012168548B2

(12) United States Patent
McLoud et al.

(10) Patent No.: US 12,168,548 B2
(45) Date of Patent: Dec. 17, 2024

(54) WIRE HANDLE ACCESSORY

(71) Applicants: Jason F. McLoud, Campbell, CA (US); Scott L. Stephens, San Jose, CA (US)

(72) Inventors: Jason F. McLoud, Campbell, CA (US); Scott L. Stephens, San Jose, CA (US)

( * ) Notice: Subject to any disclaimer, the term of this patent is extended or adjusted under 35 U.S.C. 154(b) by 0 days.

(21) Appl. No.: 17/854,574

(22) Filed: Jun. 30, 2022

(65) Prior Publication Data

US 2023/0019392 A1 Jan. 19, 2023

Related U.S. Application Data

(60) Provisional application No. 63/223,487, filed on Jul. 19, 2021.

(51) Int. Cl.
*B65D 25/28* (2006.01)
*B65D 25/32* (2006.01)

(52) U.S. Cl.
CPC ..... *B65D 25/32* (2013.01)

(58) Field of Classification Search
CPC ..... B65D 25/32; B65D 25/28; B65D 23/108; B65D 2525/285; A45F 5/1046; A45F 5/10; A45F 5/102; A47J 45/065; A47J 45/18
USPC ..... 220/760, 755, 773; 294/27.1, 137
See application file for complete search history.

(56) References Cited

U.S. PATENT DOCUMENTS

| | | | | |
|---|---|---|---|---|
| 1,219,402 | A * | 3/1917 | Rutan | B22D 41/06 294/68.27 |
| 1,226,403 | A | 5/1917 | Snyder | |
| 2,287,329 | A | 6/1942 | Santa Maria | |
| 2,294,197 | A | 8/1942 | Moore | |
| 2,554,795 | A | 9/1948 | Rupert | |
| 2,677,444 | A | 5/1954 | Drogin | |
| 3,262,727 | A | 7/1966 | Blackaby | |
| 3,679,103 | A | 7/1972 | Chmela | |
| 4,823,433 | A | 4/1989 | Curtis | |
| 5,026,105 | A | 6/1991 | Feldman | |
| 5,092,481 | A | 3/1992 | Skelton | |
| 6,336,255 | B1 * | 1/2002 | Gallup | B67B 7/14 16/110.1 |
| 6,708,838 | B2 | 3/2004 | Bergman | |
| 7,047,604 | B2 | 5/2006 | Axel | |

(Continued)

*Primary Examiner* — King M Chu

(57) ABSTRACT

A wire handle accessory for use with a wire handle has a body having a first end portion, a second end portion, an upper portion, and a bottom portion, the upper portion including a channel that extends from the first end portion to the second end portion, the channel having an open top that forms a recess into the upper portion, wherein the recess is sized, shaped, and adapted to receive a portion of the wire handle that supports an object. A retention mechanism allows the wire handle accessory to be removably retained on the wire handle when the wire handle is received in the recess of the body. The bottom portion of the body includes a grasping surface that is graspable by a user when carrying the object, the bottom portion surface having a width that is larger than the width of the wire handle that is receivable in the recess so that the weight of the object can be distributed across a wider surface than when the wire handle alone is used to carry the object. In one version, the first end portion and/or second end portion of the body comprises a tool, such as a paint can opener.

20 Claims, 6 Drawing Sheets

(56) References Cited

U.S. PATENT DOCUMENTS

| | | | | |
|---|---|---|---|---|
| 8,413,839 | B2 * | 4/2013 | Horvath | B65D 25/32<br>16/421 |
| D761,566 | S | 7/2016 | Horvath | |
| 9,539,851 | B1 | 1/2017 | Tanda | |
| 9,545,142 | B2 | 1/2017 | Pitchforth | |
| 2006/0017300 | A1 | 1/2006 | Erickson | |

* cited by examiner

WIRE HANDLE ACCESSORY

PRIORITY

The present application claims the benefit of domestic priority based on U.S. Provisional Patent Application 63/223,487 filed on Jul. 19, 2021, the entirety of which is incorporated herein by reference.

BACKGROUND

The conventional one gallon paint can with a wire bail handle has been in use for more than 150 years, and for more than 150 years users have been frustrated with its design.

A bail handle, often called simply a bail, is a handle made of a wire or the like that rotates about two mounts on the sides of an object that is to be carried. The bail handle is often made of a metal wire but is sometimes plastic or other material. The bail handle is most often associated with a one gallon paint can and other sized paint cans, but is also used for other items, such as buckets, pots, lanterns, and numerous other items or objects.

The first problem with a bail handle, particularly when it comes to bail handles on paint cans, is that it can be uncomfortable to carry. The bail handle can dig into the fingers of a user carrying the paint can. Because of the thinness of the wire of the bail handle, the load is concentrated to a thin strip across one or more fingers. This can lead to achy fingers, especially when the user is carrying the paint can for a long period of time. The discomfort is increased when the paint can is full of paint and/or when a user carries more than one can. Extended carrying and/or repetitive carrying can lead to more severe discomfort or disorders, such as numb fingers and decreased circulation.

A second problem with the conventional paint can is that the can is very difficult to open without the proper tool. A conventional paint can has a friction fit plug type of closure that must be pried off in order to be opened. The prying process requires applying a radially inward force on a lip of the closure and also a lifting force. Often a flat head screw driver, butter knife, keys, pocket knife, or the like is used, but those are not always available to the user of the paint can. Specific paint can pry tools have been developed, but they are hard to keep up with or keep track of and are easily misplaced and/or forgotten.

Therefore, there is a need for a wire handle accessory that reduces the discomfort of using a wire handle to carry an item or object such as a paint can. There is a further need for a wire handle accessory that reduces the discomfort of using a wire handle and is easy to use from any orientation or angle. There is a further need for a wire handle accessory that serves as a paint can opener and that is conveniently locatable and/or storable. There is a further need for a wire handle accessory that reduces the discomfort of carrying a paint can and that serves as a paint can opener that is conveniently locatable and/or storable.

SUMMARY

The present invention satisfies these needs. In one aspect of the invention, an improved wire handle accessory is provided.

In another aspect of the invention, a wire handle accessory is provided that reduces the discomfort of using a wire handle to carry an object such as a paint can.

In another aspect of the invention, a wire handle accessory is provided that reduces the discomfort of using a wire handle to carry an object such as a paint can in a convenient manner and/or in a manner that is independent of orientation.

In another aspect of the invention, a wire handle accessory is provided that reduces the discomfort of using a wire handle to carry an object such as a paint can and that resides substantially within the interior of the frame of the wire handle when attached to the wire handle.

In another aspect of the invention, a wire handle accessory serves as a paint can opener that is conveniently locatable and/or storable.

In another aspect of the invention, a wire handle accessory is provided that reduces the discomfort of using a wire handle to carry an object such as a paint can and also serves as a paint can opener.

In another aspect of the invention, a wire handle accessory for use with a wire handle comprises a body having a first end portion, a second end portion, an upper a top-portion, and a bottom portion, the upper portion including a channel that extends from the first end portion to the second end portion, the channel having an open top that forms a recess into the upper top-portion, wherein the recess is sized, shaped, and adapted to receive a portion of the wire handle that supports an object, and a retention mechanism that allows the wire handle accessory to be removably retained on the wire handle when the wire handle is received in the recess of the body, wherein the bottom portion of the body includes a grasping surface that is graspable by a user when carrying the object, the bottom portion surface having a width that is larger than the width of the wire handle that is receivable in the recess so that the weight of the object can be distributed across a wider surface than when the wire handle alone is used to carry the object, and wherein the first end portion of the body comprises a tool.

In another aspect of the invention, a wire handle accessory for use with a wire handle comprises a body having a first end portion, a second end portion, an upper a top-portion, and a bottom portion, the upper portion including a channel that extends from the first end portion to the second end portion, the channel having an open top that forms a recess into the upper top-portion, wherein the recess is sized, shaped, and adapted to receive a portion of the wire handle that supports an object, and a retention mechanism that allows the wire handle accessory to be removably retained on the wire handle when the wire handle is received in the recess of the body, wherein the bottom portion of the body includes a grasping surface that is graspable by a user when carrying the object, the bottom portion surface having a width that is larger than the width of the wire handle that is receivable in the recess so that the weight of the object can be distributed across a wider surface than when the wire handle alone is used to carry the object, and wherein the first end portion of the body comprises a tool, wherein the tool comprises a paint can opening tool comprising a prying member.

In another aspect of the invention, a wire handle accessory for use with a wire handle comprises a body having a first end portion, a second end portion, an upper portion, and a bottom portion, the upper portion including a channel that extends from the first end portion to the second end portion, the channel having an open top that forms a recess into the upper portion, wherein the recess is size, shaped, and adapted to receive a portion of the wire handle that supports an object, and a retention mechanism that allows the wire handle accessory to be removably retained on the wire handle when the wire handle is received in the recess of the body, wherein the retention mechanism comprises one or more protrusions extending from one or more side walls of the channel, wherein the bottom portion of the body includes a grasping surface that is graspable by a user when carrying the object, the bottom portion surface having a width that is larger than the width of the wire handle that is receivable in the recess so that the weight of the object can be distributed across a wider surface than when the wire handle alone is used to carry the object, and wherein the grasping surface is symmetrical about a transverse axis extending from a front side to a back side of the body and wherein the body is symmetrical about a longitudinal axis extending from the first end portion to the second end portion.

In another aspect of the invention, a wire handle accessory for use with a wire handle comprises a body having a first end portion, a second end portion, an upper portion, and a bottom portion, the upper portion including a channel that extends from the first end portion to the second end portion, the channel having an open top that forms a recess into the upper portion, wherein the recess is size, shaped, and adapted to receive a portion of the wire handle that supports an object, and a retention mechanism that allows the wire handle accessory to be removably retained on the wire handle when the wire handle is received in the recess of the body, wherein the bottom portion of the body includes a grasping surface that is graspable by a user when carrying the object, the bottom portion surface having a width that is larger than the width of the wire handle that is receivable in the recess so that the weight of the object can be distributed across a wider surface than when the wire handle alone is used to carry the object, and wherein the grasping surface comprises a hooking mechanism.

In another aspect of the invention, a method of using a wire handle accessory in accordance with any of the above and/or below is provided.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to an accessory useful with handles having a wire or thin handle. In particular, the invention relates to an accessory for a bail handle. Although the bail handle accessory is illustrated and described in the context of being useful as a paint can accessory, the present invention can be useful in other instances. Accordingly, the present invention is not intended to be limited to the examples and embodiments described herein.

Figure 1A:
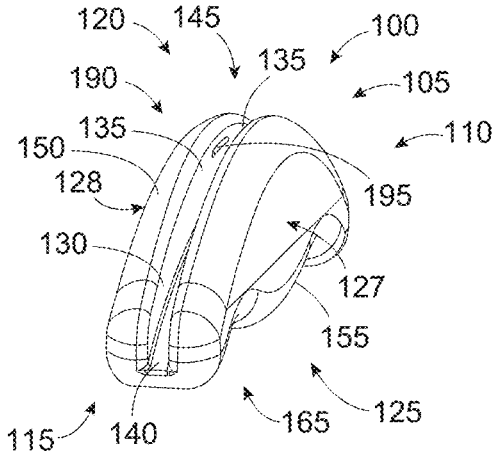
FIG. 1A is a schematic perspective view of a wire handle accessory according to a version of the invention.
Figure 1B:
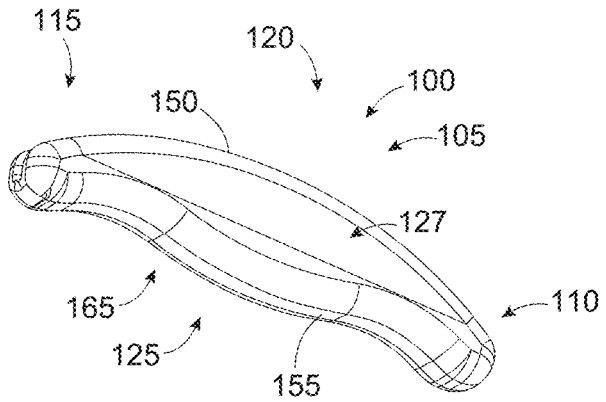
FIG. 1B is a schematic perspective bottom view of the wire handle accessory of FIG. 1A.
Figure 1C:
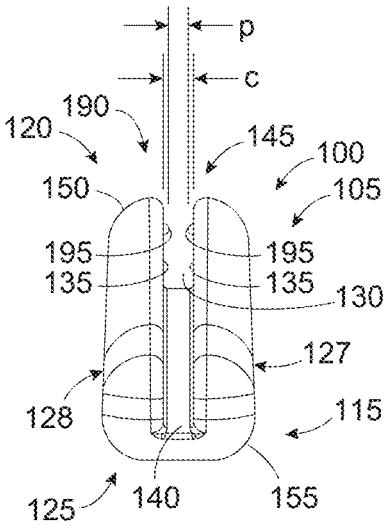
FIG. 1C is a schematic side view of the wire handle accessory of FIG. 1A.

FIGS. 1A, 1B, and 1C show a wire handle accessory 100 according to one version of present invention adapted to reduce the discomfort associated with the use of a wire handle. The wire handle accessory includes a body 105 having a first end portion 110, a second end portion 115, an upper portion 120, a lower portion 125, a front side 127, and a back side 128. The upper portion 120 includes a channel 130 that extends from the first end 110 to the second end 115. The channel 130 is made up of opposing side walls 135, a bottom surface 140, and an open top 145 so that the channel 130 forms a recess into an upper surface 150 of the upper portion 120 of the body 105. The lower portion 125 includes a lower surface 155 along the exterior of the body 105. The lower surface 155 and the bottom surface 140 of the channel 130 are separated from one another by material of the lower portion 120 of the body and both extend from the first end 110 to the second end 115 in generally the same direction. The lower surface 155 and the bottom surface 140 of the channel 130 may be parallel, generally parallel, or non-parallel to one another. The bottom surface 140 of the channel 130 may be flat in its transverse cross-section, as shown in FIGS. 1A and 1C. Alternatively, it may be curved, angular, and/or the like.

Figure 1D:
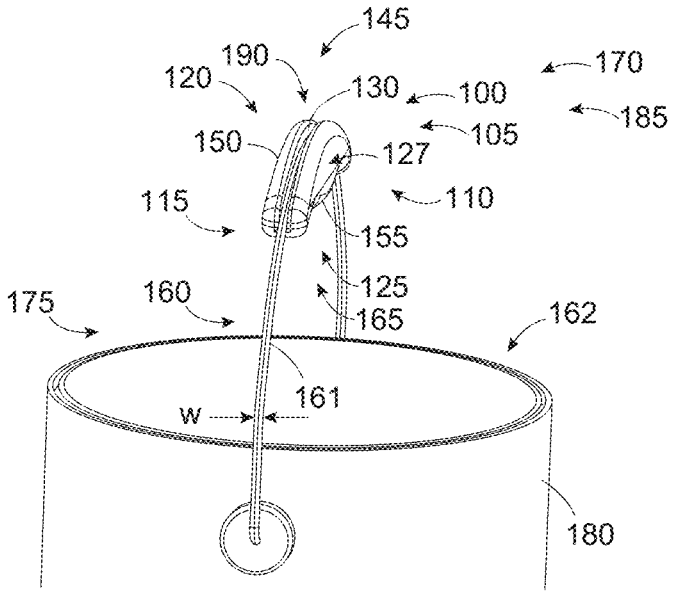
FIG. 1D is a schematic perspective side view of the wire handle accessory of FIG. 1A being used as a paint can accessory.

As shown in FIG. 1D, the channel 130 of the upper portion 120 of the body 105 of the wire handle accessory 100 is sized, shaped, and adapted to receive a portion of a wire handle 160. The wire handle 160 comprises a wire portion 161 that is intended to be grasped by a user to carry an object 162. The side walls 135 of the channel 130 are separated from one another by a distance, c, as shown in FIG. 1C that is larger than the wire width, w, thus allowing the wire portion 161 to be received within the channel 130 so that it may contact the bottom surface 140 of the channel 130. The vertical, longitudinal cross-sectional shape and contour of the bottom surface 140 of the channel 130 can be designed to match or correspond to the shape of the wire portion 161 of the wire handle 160. For example, as shown in FIG. 1D, the wire handle 160 can have a round or arcuate shape that is matched by the bottom surface 140 of the channel 130 so that the two surfaces mate or substantially mate with one another. Alternatively, the wine handle 160 and the bottom surface 130 of the channel 140 can have different shapes and/or the wire handle 160 can be sufficiently flexible to conform to the shape of the bottom surface 130 of the channel 140.

The wire handle accessory 100 reduces the discomfort associated with lifting an object 162 with a wire handle 160. The width, w, of the wire portion 161 of the wire handle 160 is often so small that the carrying of the object 162 by lifting the wire portion is uncomfortable for the user. The lower surface 155 of the wire handle accessory 100 has a width in its transverse cross-section that is wider than the width, w, of the wire portion 161. When the wire portion 161 is received within the channel 130 of the wire handle accessory, a user may grasp the lower surface 155 or grasping surface of the wire handle accessory 100 to lift the object 162 rather than directly grasp the wire portion 161. When the user lifts up on the lower surface 155, the bottom surface 140 of the channel 130 lifts up on the wire portion 161 and causes the object 162 to lift when sufficient lifting force is applied. The lower surface 155 thus distributes the weight of the object 162 across a wider surface when the wire portion 161 is contacted directly in the absence of the wire handle accessory 100, thus making the lifting process more comfortable for the user. The wider surface of the lower surface 155 distributes the load over a larger portion of the fingers of the user rather than digging into the fingers and causing discomfort for the user. This improved comfort is even more pronounced when the object 162 is heavy, when the object 162 needs to be carried for a long period of time, and/or when multiple objects 162 are being carried at the same time. The lower surface 155 of the wire handle accessory 100 can have any suitable shape or contour. For example, as shown in FIG. 1B, the lower surface can have an ergonomic contour 165 that is curved in one or both of its longitudinal and its transverse cross-sections to make it more easily and/or more comfortably graspable by the user.

FIG. 1D illustrates a particularly useful application of the wire handle accessory 100. In this version, the wire handle accessory 100 is a bail handle accessory 170. In the version shown the wire handle 160 is a bail handle 175. A bail handle, sometimes called a bail, is a handle made of a wire portion 161 or the like that rotates about two mounts 176 on the sides of an object 62 that is to be lifted or carried. The bail handle 175 is often made of a metal wire but is sometimes plastic or other material. The bail handle 175 can be used to carry numerous object 162, such as cans, buckets, pots, lanterns, and the like.

A bail handle 170 is often used with a paint can 180, such as the one-gallon paint can shown in FIG. 1D. Accordingly, the bail handle accessory 170 is particularly useful as a paint can accessory 185 for use with paint cans having a bail handle 175. By paint can it is meant any can that is adapted to and/or capable of carrying paint, whether or not paint is being carried within the can. The can may be used to carry and/or store paint or can be used to carry items other than paint. By paint it is meant any liquid that is intended to be applied to a surface to alter the appearance and/or treat the surface, examples of which include water-based paints, acrylic-based paints, oil-based paints, primers, stains, lacquers, and the like. In the version shown in FIG. 1D, the contour of the bottom surface 140 of the channel 130 can be shaped to match the contour of a conventional bail handle 175 of a one-gallon paint can 180.

In one version, such as shown in FIGS. 1A through 1D, the wire handle accessory 100 can include a retention mechanism 190. The retention mechanism 190 allows the wire handle accessory 100 to be retained and/or stored on the wire portion 161 when not being used to lift the object 162. In the version shown, the retention mechanism 195 comprises one or more protrusions 195 that extend from one or both side walls 135 and into the channel 130. The protrusions 195 create a clearance distance, p, that is less than the width, c, of the channel. By designing the clearance distance, p, of the protrusions 195 to be smaller than the width, w, of the wire portion 161, the wire handle accessory 100 can be retained on the wire portion 161 after the wire portion 161 is inserted into the channel 130. Accordingly, when it is desired that the wire handle accessory 100 be stored, it can be snapped onto the wire portion 161 by positioning the wire portion within the channel 130 and pressing against the lower surface 155 so that the wire portion 161 passes through the gap between the protrusion 195. The wire handle accessory 100 can then be snapped off in the opposite manner when it is desire to use the wire handle accessory 100.

In one version, the retention mechanism 190 of the wire handle accessory 100 is designed so that the wire handle accessory 100 is removably attachable to the wire portion 161. In this version, the one or more projections 195 are designed so that they may be deformed under a predetermined about of force so that the wire portion 161 which has a larger width, w, than the undeformed protrusion clearance, p, may pass through the deformed clearance. By making the predetermined amount of force to be greater than the weight of the wire handle accessory 100, the wire handle accessory 100 will be held onto the wire portion 161 by the protrusions 195. When it is desired to remove the wire handle accessory 100 from the wire portion 161, sufficient force is applied to pull the wire portion 161 through the clearance of the protrusions 195 and thereby pull the wire handle accessory off of the wire portion 161. In this manner the wire handle accessory 100 can be used to lift multiple objects 162.

Figure 2A:
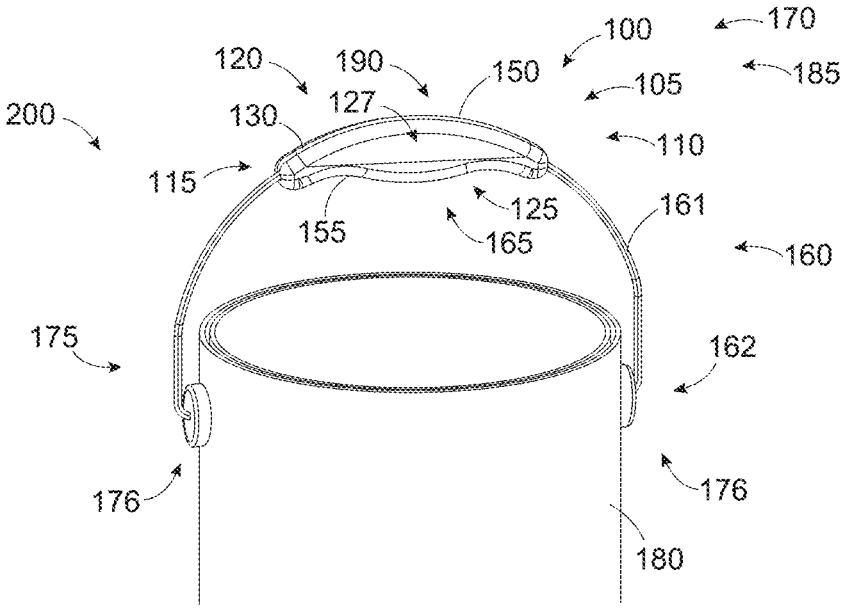
FIG. 2A is a schematic perspective front view of the wire handle accessory of FIG. 1A being used as a paint can accessory with the bail handle of a paint can in a carrying configuration.
Figure 2B:
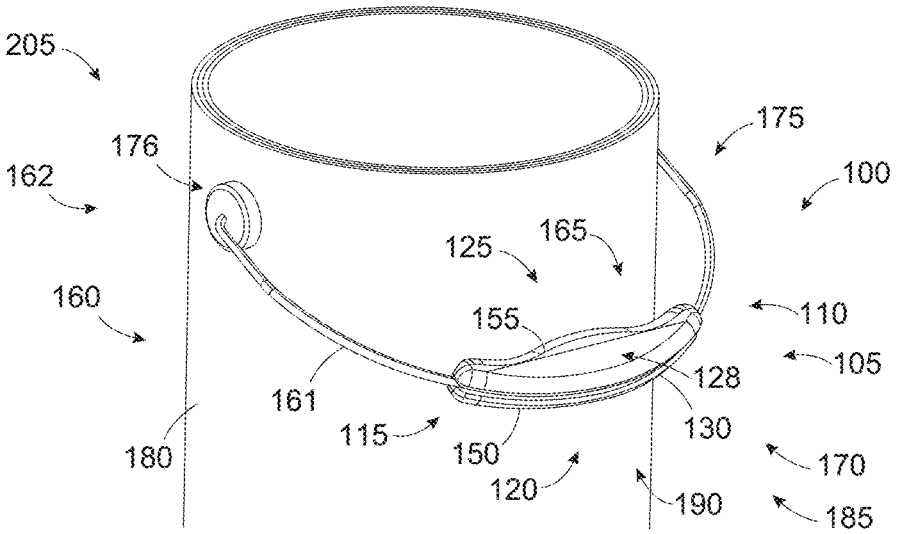
FIG. 2B is a schematic perspective front view of the wire handle accessory of FIG. 1A being used as a paint can accessory with the bail handle of a paint can in a storage configuration.
Figure 3A:
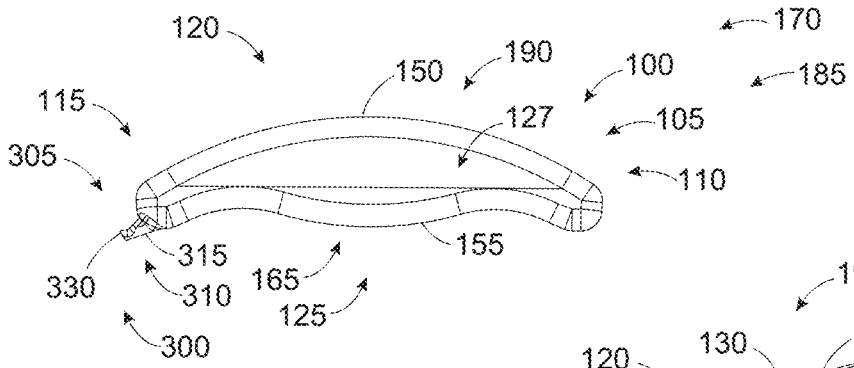
FIG. 3A is a schematic front view of another version of a wire handle accessory according to the invention.
Figure 3B:
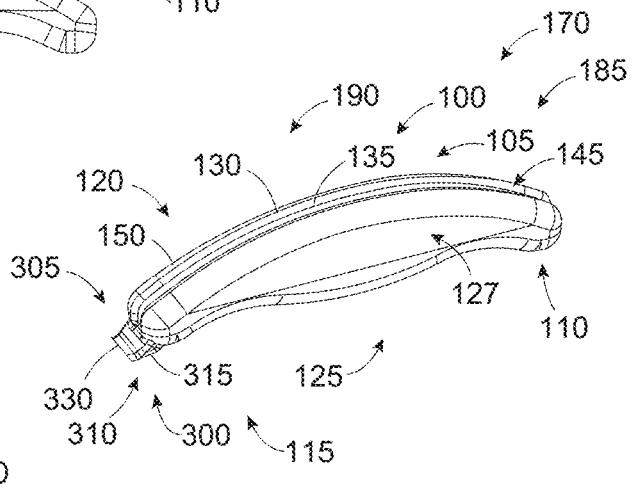
FIG. 3B is a schematic perspective top view of the wire handle accessory of FIG. 3A.
Figure 3C:
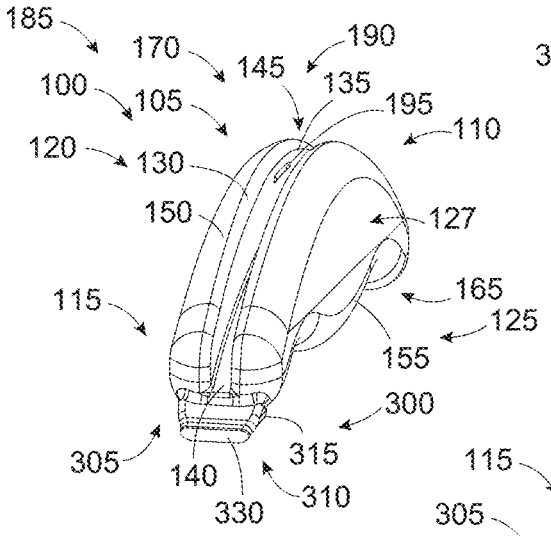
FIG. 3C is a schematic perspective front-side view of the wire handle accessory of FIG. 3A.
Figure 3D:
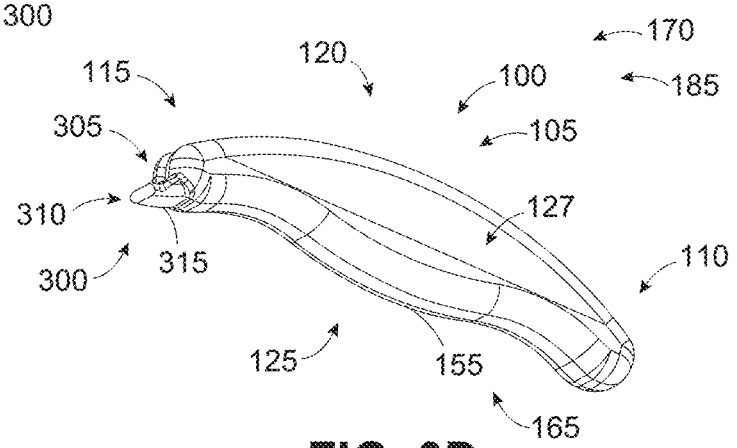
FIG. 3D is a schematic perspective bottom view of the wire handle accessory of FIG. 3A.

The retention and storage of the wire handle accessory 100 when used as a paint can accessory 185 is further illustrated in FIGS. 2A and 2B. The bail handle 175 of the paint can 180 can be swung from an upright position 200 or carrying configuration as shown in FIG. 2A or can rest is a lowered position 205 or storage configuration as shown in FIG. 2B. The wire handle accessory 100 is retained on the wire portion 161 in either position. As can be seen, the terms "top" and "upper" and "bottom" and "lower" and "front" and "back" and the like relate to the positioning of the wire handle accessory when in attached to a handle in the upright position 200. In the version shown in FIGS. 2A and 2B, the wire handle accessory is attached onto the wire portion 161 and remains there during carrying and storage of the paint can 180 until it is removed. Alternatively, the wire handle accessory can be attached onto the wire portion 161 when the paint can 180 is to be carried and can be removed when the paint can 180 is being stored.

Another version of a wire handle accessory 100 that is particularly useful as a paint can accessory 185 is shown in FIGS. 3A, 3B, 3C, and 3D. The wire handle accessory of FIGS. 3A through 3D is similar to the wire handle accessory of FIGS. 1A through 1C, but in the version of FIGS. 3A through 3D, the wire handle accessory 100 is equipped with a tool 300 at the first end portion 110 and/or the second end portion 115. In the version shown, the tool 300 is a paint can opening tool 305 that includes a prying member 310. The prying member 310 is an extension portion 315 that extends outwardly from the end of the wire handle accessory 100.

Figure 4A:
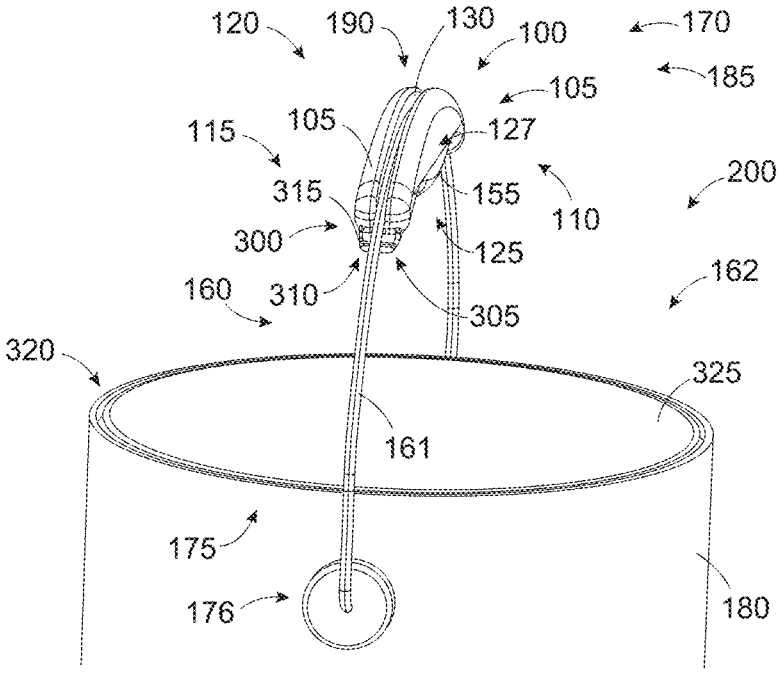
FIG. 4A is a schematic perspective side view of the wire handle accessory of FIG. 3A being used as a paint can accessory.
Figure 4B:
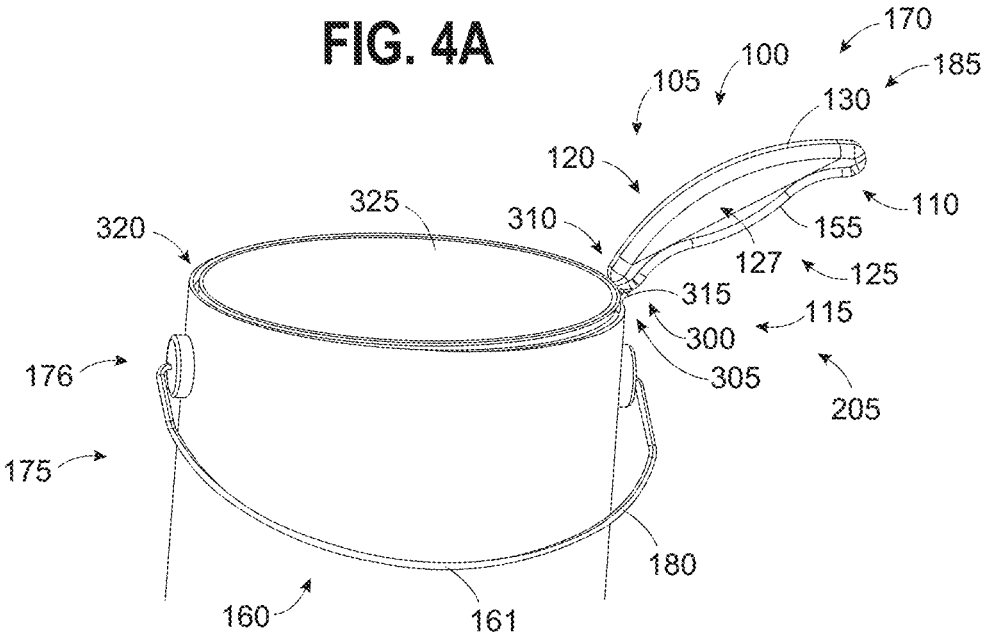
FIG. 4B is a schematic perspective side view of the wire handle accessory of FIG. 4A removed from the bail handle of the paint can and being used as a prying tool.

The operation of wire handle accessory 100 of FIGS. 3A through 3D is shown in FIGS. 4A and 4B. In FIG. 4A, the wire handle accessory 100 is shown attached the wire portion 161 of the bail handle 175 in the same manner as discussed above. In the upright position 200 of FIG. 4A, the wire handle accessory 100 can be used to lift and carry the paint can 180 in a more comfortable manner than without the accessory. Then, when the user desires to open the paint can 180, the user can remove the wire handle accessory 100 from the wire portion 161 and use the paint can opening tool 305 to open the paint can 180. The extension portion 315 of the prying member 310 of the opening tool 305 and is sized and shaped to be insertable under a conventional friction fit plug type of lid closure 320 of a paint can 180 so that the lid 325 of the paint can 180 can be removed. Optionally, an upwardly extending lip portion 330 can be provided at the tip of the extension portion 315 to help the prying member 310 grip onto the lid 325 to better grip and manipulate the lid 325. Alternatively, the lip portion 330 can be removed so the extension portion 315 can be used as a screw driver, scraper, and/or the like.

Figure 5A:
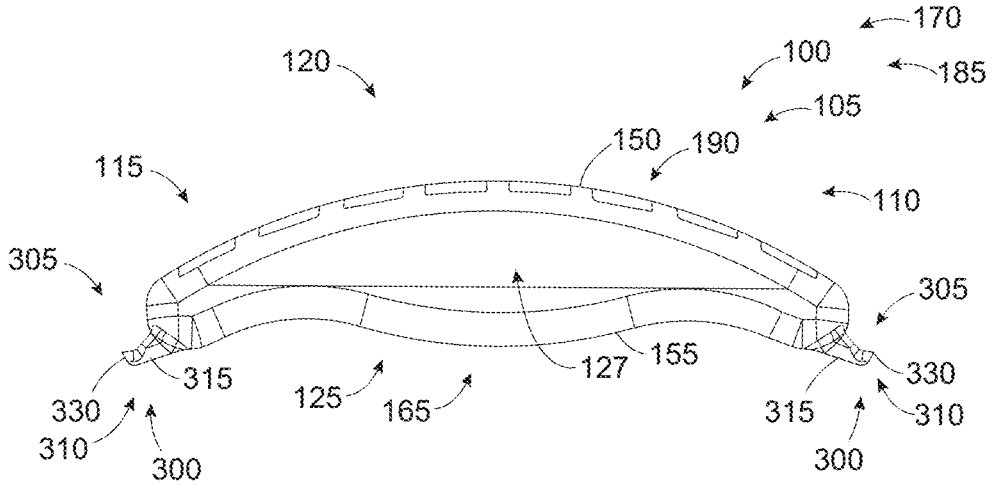
FIG. 5A is a schematic front view of another version of a wire handle accessory according to the invention.
Figure 5B:
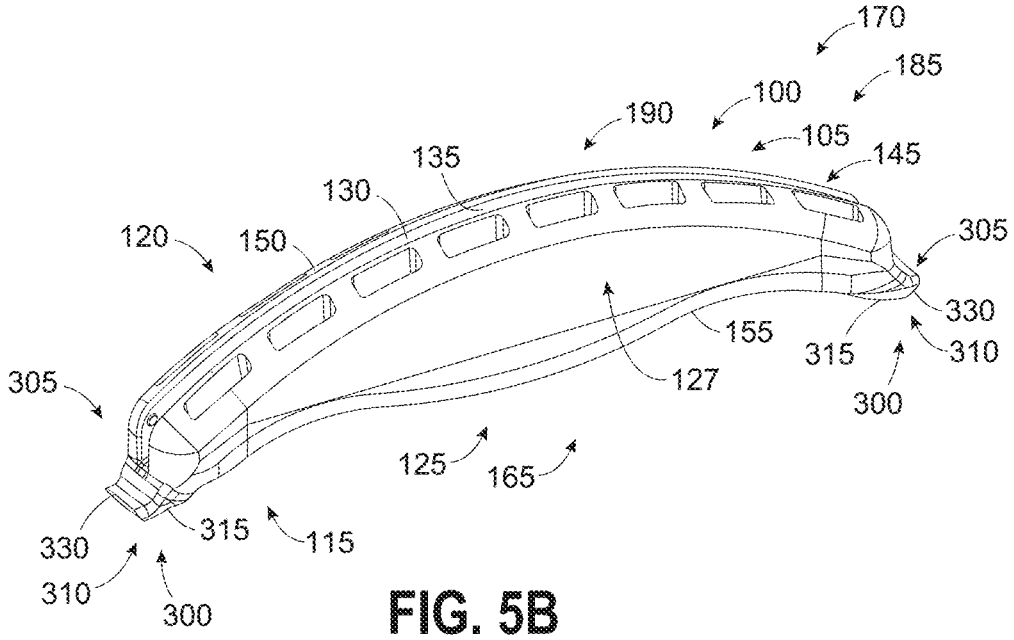
FIG. 5B is a schematic perspective top view of the wire handle accessory of FIG. 5A.

Another version of a wire handle accessory 100 that is particularly useful as a paint can accessory 185 is shown in FIGS. 5A and 5B. The wire handle accessory of FIGS. 5A and 5B is similar to the wire handle accessory of FIGS. 3A through 3D, but in the version of FIGS. 5A and 5B, the wire handle accessory 100 is equipped with a tool 300 at both the first end 110 and the second end 115. In the version shown, the tool 300 is a paint can opening tool 305 that includes a prying member 310. The prying member 310 is an extension portion 315 that extends outwardly from the end of the wire handle accessory 100. In the particular version shown, the paint can opening tool 305 is provided on both the first end 110 and the second end 115. With this version, have a paint can opening tool 305 on both ends is advantageous for ease of use, dexterity, and efficiency. Alternatively, in another version, the tool 300 on the first end 110 can be different than the tool 300 on the second end. For example, one end can have a paint can opening tool 305 and the other end can have a Phillips head screwdriver or similar. The voids shown in FIG. 5B can be provide to facilitate moldability of the device. The voids may also be omitted.

Figure 6:
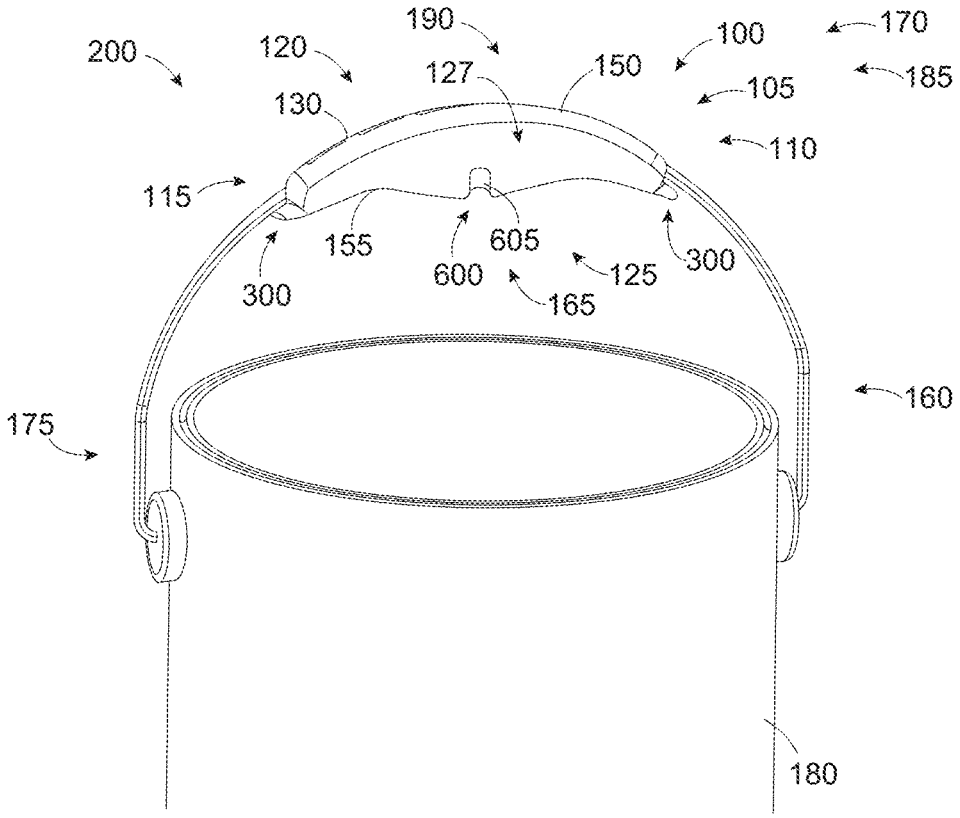
FIG. 6 is a schematic perspective front view of another version of a wire handle accessory being used as a paint can accessory with the bail handle of a paint can in a carrying configuration.

Another version of a wire handle accessory 100 that is particularly useful as a paint can accessory 185 is shown in FIG. 6. In this version, a hooking mechanism 600 is provided on the lower portion 120 of the body 105. In the version shown, the hooking mechanism 600 is a groove 605 that extends laterally across the lower surface 155. The hooking mechanism 600 is useful for allowing the wire handle accessory to accommodate a painter's hook. Wire handles on paint cans are often used to hang a can of paint from a painter's hook on a ladder or other object. With the hooking mechanism 600, the paint can 180 can be hung from a painter's hook or the like even while the wire handle accessory 100 is stored on the wire portion 161. Alternatively, the wire handle accessory 100 can be removed from the wire portion 161 and the paint can can be hung from a hook in a conventional manner.

The body 105 of the wire handle accessory 100 can be made of any suitable material sufficiently strong for the intended version. For example, in one version, the body may be composes of one or more thermoplastic, such as one or more of acrylic, acrylonitrile butadiene styrene, nylon, polycarbonate, polyether sulfone, polyoxymethylene, polyetherimide, polyethylenen, polypropylene, polystyrene, polyvinyl chloride, polytetrafluoroethylene, and the like; metal; alloy; and carbon fiber, and the like. In one particular version, the wire handle accessory 100 comprises acrylonitrile butadiene styrene. In another version, the wire handle accessory 100 comprises polycarbonate. In another version, the wire hand accessory 100 comprises polypropylene. The body 105 can be made of a single piece or multiple pieces that are integrally assembled together.

In one version of the wire handle accessory 100, the body 105 can be designed to make the use and operation of the wire handle accessory 100 more convenient and/or accessible. In one particular version, the body 105, wire handle accessory 100 and/or a portion of either can have one or more axes of symmetry. For example, the body 190 and/or the lower surface 155 of the body 190 can have symmetry with respect to the first end and the second end. In this regard, the lower surface 155 that is to be grasped can be symmetric about a transverse axis that extends from a front side to a back side of the body 190, such as at a midpoint of the body 190 between the first end portion 110 and the second end portion 115. By being symmetric in this manner, the lower surface 155 can be grasped by either the left hand or the right hand of a user without any differences to the feel of the lower surface 155 and/or the ergonomic contour 165. Additionally or alternatively, the body 190 and/or lower surface 155 can have symmetry from front to back about a longitudinal axis that extends from the first end portion 110 to the second end portion 115, such as at midpoint of the body between the front side and the back side. By being symmetric in this manner, the lower surface can be grasped by either reaching from the front of the paint can or other object or from the rear of the paint can or other object without any differences to the feel of the lower surface 155 and/or the ergonomic contour 165.

In one version, the wire handle accessory 100 can be designed to be retained on the wire handle 160 in a manner that does not interfere with the operation of the wire handle 160. For example, the wire handle accessory 100 can be designed to reside substantially within the frame of the wire handle, i.e. in the space between the wire handle 160 and the object 162. In this version, the wire handle accessory 100 can lack any extensions that extend substantially outside the frame of the wire handle 160. More specifically, the wire handle accessory can lack any essential components that extend more than about 1 inch above the frame of the wire handle 160, or more than 05 inches above the frame of the wire handle 160. In one particular version, as shown, the wire handle accessory lacks any portion or any essential portion that extend above the frame of the wire handle 160 by more than the depth of the channel 130.

The shape and dimensions of the body 105 of the wire handle accessory 100 can be selected to suit a desired application. For example, as discussed above, the wire handle accessory 100 can be designed to be attachable onto a conventional one-gallon paint can bail handle. Alternatively, the wire handle accessory 100 can be designed to fit onto any other bail handle or wire handle or any handle that would benefit from a distributed load. When being designed to be attachable to a wire portion 161 of a handle, the distance, c, between the side walls 135 of the channel 130 can be selected to be larger than the width, w, of the wire portion 161 to be received within the channel 130. In one version, for a conventional paint can wire portion 161, c can be chosen to be from about 0.03 inches to about 0.20 inches, more preferably from about 0.11 inches to about 0.14 inches. The one or more protrusions 195 can extend from the sidewall 135 from about 0.005 inches to about 0.06 inches, more preferably from about 0.007 inches to about 0.018 inches. Accordingly, the protrusion clearance, p, can be chosen to be from about 0.07 inches to about 0.13 inches, or can be otherwise selected to be snappable onto a desired wire portion 161. The depth of the channel 130 from the top of the upper portion 120 to the bottom surface 140 can be from about 0.03 inches to about 0.20 inches, more preferably from about 0.11 inches to about 0.14 inches.

The dimensions can be adjusted to fit any desired wire handle or other type of handle, and the above ranges include all included ranges within those ranges.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number, and all directional limitations, such as up and down and the like, can be switched, reversed, or changed as long as doing so is not prohibited by the language herein with regard to a particular version of the invention. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Throughout this specification and any claims appended hereto, unless the context makes it clear otherwise, the term "consisting of" and "consisting essentially of" and their variations such as "consists" should be understood to imply the inclusion of a stated element, limitation, or step and not the exclusion of any other elements, limitations, or steps or any other non-essential elements, limitations, or steps, respectively. Throughout the specification, any discussed on a combination of elements, limitations, or steps should be understood to include a disclosure of additional elements, limitations, or steps and the disclosure of the exclusion of additional elements, limitations, or steps. All numerical values, unless otherwise made clear in the disclosure or prosecution, include either the exact value or approximations in the vicinity of the stated numerical values, such as for example about +/−ten percent or as would be recognized by a person or ordinary skill in the art in the disclosed context. The same is true for the use of the terms such as about, substantially, and the like. Also, for any numerical ranges given, unless otherwise made clear in the disclosure, during prosecution, or by being explicitly set forth in a claim, the ranges include either the exact range or approximations in the vicinity of the values at one or both of the ends of the range. When multiple ranges are provided, the disclosed ranges are intended to include any combinations of ends of the ranges with one another and including zero and infinity as possible ends of the ranges. Therefore, any appended or later filed claims should not be limited to the description of the preferred versions contained herein and should include all such alterations, permutations, and equivalents as fall within the true spirit and scope of the present invention.

What is claimed is:

1. A wire handle accessory for use with a wire handle, the wire handle accessory comprising:

a body having a first end portion, a second end portion, an upper portion, and a bottom portion, the upper portion including a channel that extends from the first end portion to the second end portion, the channel having an open top that forms a recess into the upper portion, wherein the recess is sized, shaped, and adapted to receive a portion of the wire handle that supports an object, and wherein the channel has an arcuate bottom surface contoured to correspond to the shape of a wire portion of the wire handle, and a retention mechanism that allows the wire handle accessory to be removably retained on the wire handle when the wire handle is received in the recess of the body, wherein the bottom portion of the body includes a grasping surface that is graspable by a user when carrying the object, the bottom portion surface having a width that is larger than the width of the wire handle that is receivable in the recess so that the weight of the object can be distributed across a wider surface than when the wire handle alone is used to carry the object, and wherein the first end portion of the body comprises a tool.

2. A wire handle accessory according to claim 1 wherein the tool comprises a paint can opening tool comprising a prying member.

3. A wire handle accessory according to claim 1 wherein the second end portion of the body comprises a second tool.

4. A wire handle accessory according to claim 1 wherein the tool comprises a paint can opening tool comprising a prying member and wherein the second end portion of the body comprises a second paint can opening tool comprising a prying member.

5. A wire handle accessory according to claim 1 wherein the retention mechanism comprises one or more protrusions extending from one or more side walls of the channel.

6. A wire handle accessory according to claim 1 wherein the retention mechanism comprises one or more protrusions extending from one or more side walls of the channel, the one or more protrusions create a clearance that is less than the width of the channel and less than the width of the wire handle that is receivable within the channel so that the wire handle accessory can be retained on the wire handle by snapping the wire handle through the clearance.

7. A wire handle accessory according to claim 1 wherein the grasping surface is symmetrical about a transverse axis extending from a front side to a back side of the body.

8. A wire handle accessory according to claim 1 wherein the body is symmetrical about a longitudinal axis extending from the first end portion to the second end portion.

9. A wire handle accessory according to claim 1 wherein the grasping surface comprises a hooking mechanism.

10. A wire handle accessory according to claim 1 wherein the grasping surface comprises a hooking mechanism comprising a groove that extends laterally across the grasping surface, the hooking mechanism being useful for allowing the wire handle accessory to accommodate a painter's hook on a ladder.

11. A wire handle accessory for use with a wire handle, the wire handle accessory comprising:

a body having a first end portion, a second end portion, an upper portion, and a bottom portion, the upper portion including a channel from the first end portion to the second end portion, the channel having an open top that forms a recess into the upper portion, wherein the recess is size, shaped, and adapted to receive a portion of the wire handle that supports an object, and wherein the channel has a width of from about 0.03 inches to about 0.20 inches across the upper portion, and a retention mechanism that allows the wire handle accessory to be removably retained on the wire handle when the wire handle is received in the recess of the body, wherein the retention mechanism comprises one or more protrusions extending from one or more side walls of the channel, wherein the bottom portion of the body includes a grasping surface that is graspable by a user when carrying the object, the bottom portion surface having a width that is larger than the width of the wire handle that is receivable in the recess so that the weight of the object can be distributed across a wider surface than when the wire handle alone is used to carry the object, and wherein the grasping surface is symmetrical about a transverse axis extending from a front side to a back side of the body and wherein the body is symmetrical about a longitudinal axis extending from the first end portion to the second end portion.

12. A wire handle accessory according to claim 11 wherein the first end portion of the body comprises a tool.

13. A wire handle accessory according to claim 11 wherein the first end portion of the body comprises a tool and wherein the second end portion of the body comprises a second tool.

14. A wire handle accessory according to claim 11 wherein the first end portion of the body comprises a a paint can opening tool comprising a prying member.

15. A wire handle accessory according to claim 11 wherein the one or more protrusions create a clearance that is less than the width of the channel and less than the width of the wire handle that is receivable within the channel so that the wire handle accessory can be retained on the wire handle by snapping the wire handle through the clearance, wherein the clearance is from about 0.07 inches to about 0.13 inches.

16. A wire handle accessory according to claim 11 wherein the grasping surface comprises a hooking mechanism useful for allowing the wire handle accessory to accommodate a painter's hook on a ladder.

17. A wire handle accessory for use with a wire handle, the wire handle accessory comprising:

a body having a first end portion, a second end portion, an upper portion, and a bottom portion, the upper portion including a channel that extends from the first end portion to the second end portion, the channel having an open top that forms a recess into the upper portion, wherein the recess is size, shaped, and adapted to receive a portion of the wire handle that supports an object, and a retention mechanism that allows the wire handle accessory to be removably retained on the wire handle when the wire handle is received in the recess of the body, wherein the bottom portion of the body includes a grasping surface that is graspable by a user when carrying the object, the bottom portion surface having a width that is larger than the width of the wire handle that is receivable in the recess so that the weight of the object can be distributed across a wider surface than when the wire handle alone is used to carry the object, and wherein the grasping surface comprises a hooking mechanism comprising a groove that extends laterally across the grasping surface.

18. A wire handle accessory according to claim 17 wherein the hooking mechanism is sized and shaped to be useful for allowing the wire handle accessory to accommodate a painter's hook on a ladder.

19. A wire handle accessory according to claim 17 wherein the first end portion of the body comprises a tool.

20. A wire handle accessory according to claim 17 wherein the first end portion of the body comprises a paint can opening tool comprising a prying member.

* * * * *